US005213208A

United States Patent [19]

Hillestad

[11] Patent Number: 5,213,208

[45] Date of Patent: May 25, 1993

[54] PACKAGE OPENING DEVICE

[76] Inventor: Bruce A. Hillestad, 2920 Stevens La., San Jose, Calif. 95148

[21] Appl. No.: 858,244

[22] Filed: Mar. 26, 1992

[51] Int. Cl.[5] ..... B65D 77/40

[52] U.S. Cl. ..... 206/349; 229/204

[58] Field of Search ..... 206/217, 349; 229/204, 229/101.1, 103.1; 383/61, 63, 202, 204

[56] References Cited

U.S. PATENT DOCUMENTS

| | | | |
|---|---|---|---|
| 1,020,050 | 3/1912 | Padrick | 206/349 |
| 4,749,082 | 6/1988 | Gardiner et al. | 206/349 |
| 4,785,940 | 11/1988 | Wilson | 383/204 |
| 4,801,007 | 1/1989 | Rule | 229/103.1 |
| 4,858,766 | 8/1989 | Tsai | 229/204 |
| 4,986,673 | 1/1991 | Bell | 383/61 |

*Primary Examiner*—Jimmy G. Foster
*Attorney, Agent, or Firm*—Townsend and Townsend Khourie and Crew

[57] ABSTRACT

An envelope having a cutting tool, such as a knife, removably placed therein. The envelope is provided with a closure at one end thereof so that when the closure is opened, a person can reach into the envelope, remove the cutting tool and then use the cutting tool. The envelope containing the cutting tool is coupled, preferably adhesively bonded, to the package before it is shipped to the destination.

14 Claims, 2 Drawing Sheets

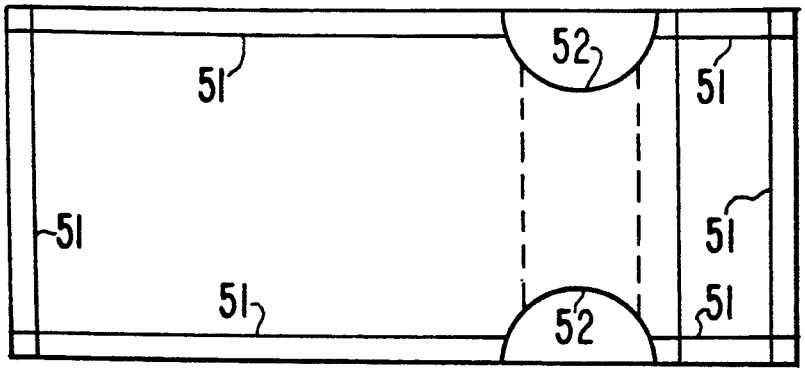
FIG.7
FIG.8
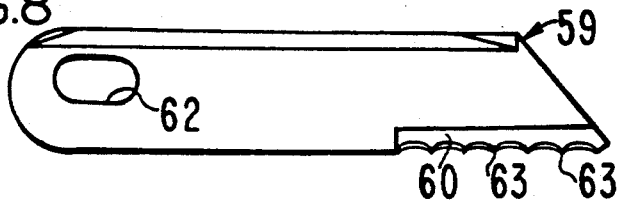
FIG.8A
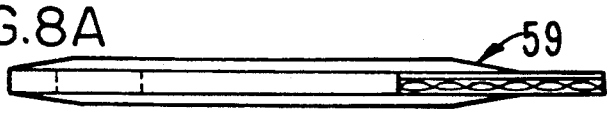
FIG.8B
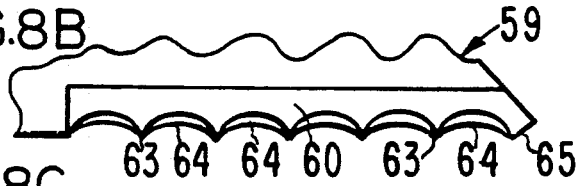
FIG.8C
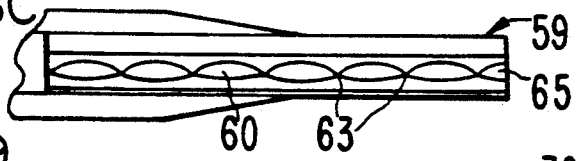
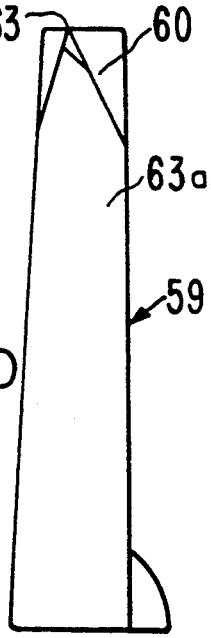
FIG.8D
FIG.9
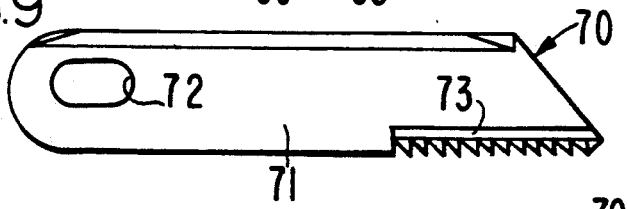
FIG.9A
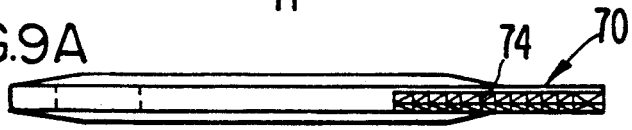
FIG.9B
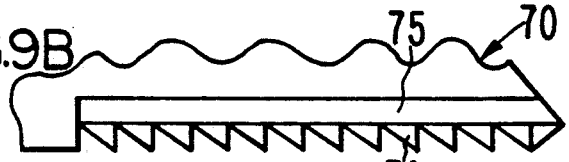
FIG.9C
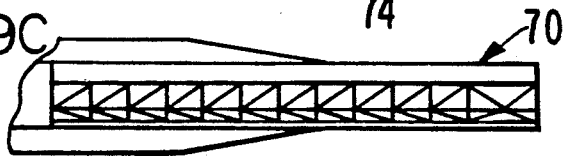
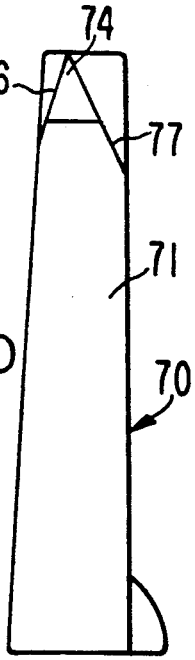
FIG.9D

PACKAGE OPENING DEVICE

This invention relates to the opening of packages to be shipped to a destination, such as cardboard cartons, boxes covered with wrapping paper and the like and, more particularly, to an envelope containing a cutting tool and capable of being attached to a package to be opened at its destination.

BACKGROUND OF THE INVENTION

Packages, such as sealed cardboard boxes and the like are often difficult to open. A person who needs to open a package of this type must often look for a pair of scissors or a knife to cut the seal. Much time is spent in trying to find such a cutting tool and, after it is found, additional time is spent in determining whether it is the proper tool or how to open the particular package. This delay represents a waste of time much to the consternation of the person trying to open the package. Because of this problem, a need exists for a cutting means which is readily accessible and which is adequate to the task of opening a package by quickly and easily cutting the material of the package in such a way that it will not interfere with the contents of the package itself. The present invention satisfies this need.

SUMMARY OF THE INVENTION

The present invention is directed to an envelope having a cutting tool, such as a knife, removably placed therein. The envelope will be one that is shipped to a destination and to be opened at the destination. The envelope is provided with a closure at one end thereof so that when the closure is opened, a person can reach into the envelope, remove the cutting tool and then use the cutting tool at the destination to cut and thereby open the package. The cutting tool can sever a packaging strip which is usually part of the wrapping on the package.

The envelope containing the cutting tool is coupled, preferably adhesively bonded, to the package before it is shipped to the destination. Before the envelope is applied to the package by an adhesive layer on the rear face of the envelope, the adhesive layer is protected by a backing sheet which can be peeled off the envelope. The envelope is generally bonded to a side or top surface of the package itself. The envelope remains on the package during shipment, and once the package reaches its destination, the envelope is generally opened while the envelope remains on the package. However, the envelope can be removed from the package to facilitate the removal of the cutting tool from the envelope. Once the cutting tool is removed manually from the envelope, the envelope can either remain on the package or be separated from it. The envelope can be thrown away and the cutting tool can also be discarded, if desired, or used for other purposes.

The primary object of this invention is to provide an improved package opening device which is carried on a package generally to be shipped to a destination, the device including a cutting tool which can be carried by and removed from an envelope and used to open the package by cutting some part of the package to thereby avoid the problems associated with the need to look for a cutting tool at the destination and to provide a cutting tool which is always accessible while the package is in transit to the destination.

Other objects of this invention will become apparent as the following specification progresses, reference being had to the accompanying drawing for an illustration of the invention.

DESCRIPTION OF THE DRAWINGS

FIG. 7 is a plan view of a second embodiment of the envelope of the present invention;

FIGS. 8 and 9 are views similar to FIG. 4 but showing second and third embodiments, respectively, of the cutting tool of the present invention;

FIGS. 8A and 9A are views similar to FIG. 5 but showing plan views of the embodiments of FIGS. 8 and 9;

FIGS. 8B and 9B are enlarged, fragmentary side elevational views of the teeth of the embodiments of FIGS. 8 and 9, respectively;

FIGS. 8C and 9C are views similar to FIGS. 8A and 9A but showing the teeth on an enlarged scale; and FIGS. 8D and 9D are enlarged, end elevational views of the teeth of the embodiments of FIGS. 8 and 9.

DESCRIPTION OF THE PREFERRED EMBODIMENT

Figure 1:
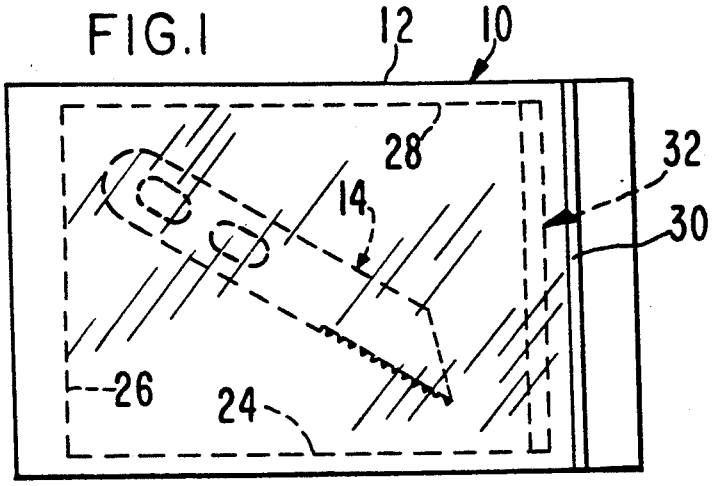
FIG. 1 is a top plan view of an envelope containing a cutting tool and adapted to be coupled to a package.

The preferred embodiment of the cutting unit of the present invention is broadly denoted by the numeral 10 and includes a first embodiment of an envelope 12, preferably of plastic material, which is at least translucent or transparent so that the interior of the envelope can be viewed. A cutting tool or knife 14 is disposed loosely within the envelope and can be taken out of the envelope after being put into the envelope. The envelope can be adhesively bonded or otherwise coupled to a package, such as a box 16 of the type shown in FIG. 1A, the envelope being shown near one corner of the box on a top surface thereof adjacent to a tape strip 18. The tape strip typically connects a pair of top flaps of the box and can be cut by manual movement of the knife along the length of the strip. Thus, with the cutting tool in the envelope and the envelope attached to the box at some suitable location, the box will have its own opening means. A person wishing to open the box need not go to any inconvenience to find a cutting tool or knife to be used to cut the tape strip 18 to separate the top flaps of the box and open the box.

The envelope 12 can be of any suitable construction, such as plastic sheet material. It can be provided with a layer of adhesive on the back side thereof for releasably attaching the envelope to the box 16. To this end, envelope 12 can be formed of two sheets of plastic material which is flexible, the sheets being denoted by the numerals 20 and 22, the two sheets being each sealed or heat welded along dashed lines 24, 26 and 28. One end 30 of the envelope is open for insertion and removal of knife 14. Closing means 32, such as zip lock means, can be used to provide a quick locking means and quick release means for opening the end opening of the envelope.

A backing sheet 34 is secured by a layer 36 of adhesive to the back side of sheet 22 and this back side of layer 22 will be adhesively bonded to the backing sheet 34 so long as the sheet 34 has not been pulled away from the envelope. The backing sheet, therefore, protects and prolongs the life of the adhesive on the back side of layer 22 with the knife 14 within the space 23 between layers 20 and 22.

Figure 6:
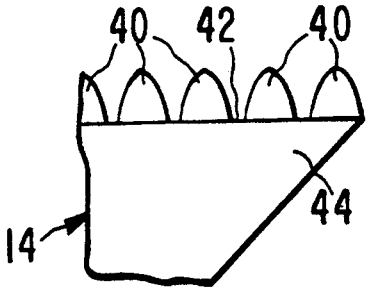
FIG. 6 is an enlarged, fragmentary side elevational view of the teeth of the cutting tool.
Figure 4:
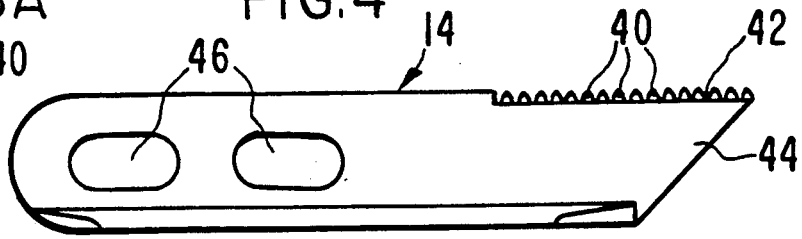
FIG. 4 is a side elevational view of the cutting tool.
Figure 5:
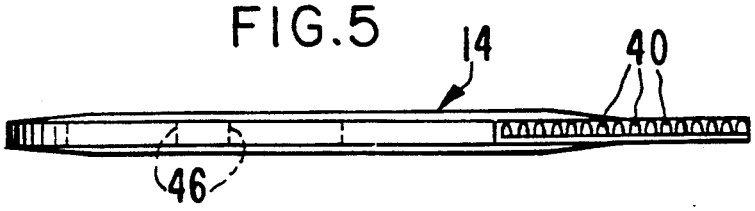
FIG. 5 is a top plan view of the tool of FIG. 4.

FIGS. 4–6 show details of the knife. The cutting tool or knife 14 is preferably made of a plastic material to minimize production costs thereof. It is of a one-piece construction and has a plurality of spaced teeth 40 along one edge 42 extending rearwardly from a pointed end 44. A pair of spaced holes 46 are formed in the knife body to provide strength therefor. The width of the knife body is shown in FIG. 5 and the shape of the teeth 40 are shown in FIG. 6.

In use, envelope 12 is provided with the backing sheet 34 thereon, the backing sheet being held by a layer 36 of adhesive to the back side of layer 22 of envelope 12. A knife 14 will have been placed in the envelope and the envelope closed by closing the zip lock means 32 in a manner which is well known.

Figure 1A:
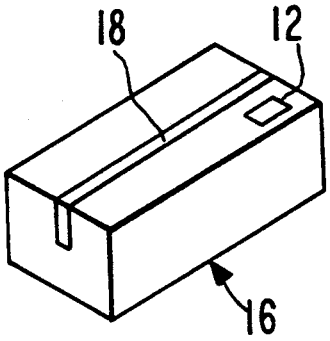
FIG. 1A is a perspective view of the package with the envelope containing the cutting tool of FIG. 1 attached to the top of the box.
Figure 2:
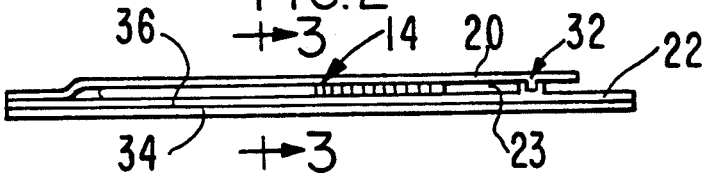
FIG. 2 is a side elevational view of the envelope and knife combination of FIG. 1.

When it is desired to ship a box 16 or other package which is to be opened at the destination, envelope 12 is first prepared by peeling the backing sheet 34 off backside surface of layer 22, thereby exposing the adhesive layer on the backside of layer 22. The envelope is then applied to a surface of the box 16, such as at the top of the box, as shown in FIG. 1A. The box is now ready for shipment to its destination.

At the destination, the envelope can be immediately opened by opening the zip lock means 32, thereby permitting access to the interior of the envelope. With the fingers of one hand, the knife is pulled out of the envelope and grasped at the end containing the holes 46. Then, the cutting teeth are applied to and moved along a portion of the box, such as along the center tape strip 18 thereof (FIG. 1A), whereupon the tape is severed and the box is opened.

Unit 10 can be used with any suitable package which can be opened by the cutting action of a knife 14. For instance, a taped box can be opened with the knife by cutting the edge of the tape on the top flap of the envelope.

Figure 3:
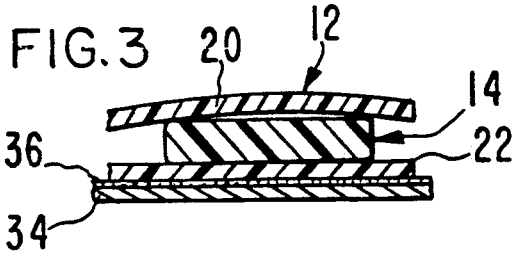
FIG. 3 is a cross-sectional view of the envelope with the cutting tool therewithin.
Figure 6A:
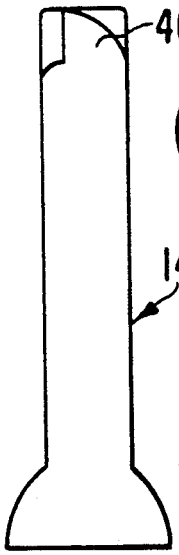
FIG. 6A is an enlarged end elevational view of a tooth of FIG. 6.

FIG. 7 shows an improved envelope of the present invention, the envelope being formed of a pair of superimposed sheets in the manner shown in FIG. 3. The sheets are heat sealed along lines 51. Thus, the envelope forms a pocket for receiving knife 14 which may be of the first embodiment shown in FIGS. 4 and 5 or second and third embodiments shown in FIGS. 8 and 9.

Envelope 50 (FIG. 7) is not heat sealed at a pair of curved edges 52 intermediate the ends of the envelope. A web 58 is secured along lines of weakness 56 to the upper sheet, the curved side edges 52 being at the ends of web 58. By pulling on web 58 at one side edge 52 thereof, the web is torn along lines 56 and the adjacent end of the envelope is opened to gain access to the knife inside the envelope. Thus, the envelope of FIG. 7 has quick release means in the form of web 58 and lines 56 of weakness or score lines. The envelope is applied by adhesive in the same manner as that described above with respect to the envelope of FIG. 1. Web 58 forms part of the upper sheet of the envelope.

FIGS. 8 and 9 show second and third embodiments of knives for carrying out the teachings of the present invention. The knife of FIG. 8 is denoted by the numeral 59 and includes a single hole 62 through the body 63*a* of the knife for reducing the weight of the knife. Cutting tool 59 also has an improved blade portion 60 which is integral with the main body 57 of the knife. Blade 60 includes teeth 63 which are spaced along the length of blade 60 and a cutting edge 64 is between each pair of adjacent teeth 63. A leading edge 65 on blade 60 serves to initiate the cutting action of the blade when the knife is used to open a package.

FIG. 9 shows still a third embodiment of the knife of the present invention. The knife of FIG. 9 is denoted by the numeral 70 and includes a knife body 71 having a single hole 72 therethrough for cutting down on the weight of the knife. A plurality of teeth define a blade 73 having individual, aligned teeth 74 as shown on blade portion 75. Each tooth 74 has a pair of convergent sides 76 and 77 which are integral with the tooth body 71.

The embodiments of FIGS. 8 and 9 are used in the same manner as that described above with respect to the embodiment of FIG. 4.

What is claimed is:

1. A package opening unit comprising:

an envelope having an open end and means for closing said open end;

a cutting tool removably placed within the envelope and held therein when the envelope is closed, said envelope having a surface provided with means for attaching the envelope to a package to be opened; and a layer of adhesive on said surface, and a backing sheet for adhesively covering the adhesive layer on the backing sheet of the envelope to protect the adhesive layer until the envelope is to be attached to a package to be opened.

2. A device as set forth in claim 1, wherein the envelope is made of plastic material.

3. A device as set forth in claim 1, wherein said envelope comprises a pair of superposed sheets of plastic, said sheets being heat welded along three sides, the fourth side being open to permit insertion of the cutting tool into and removal of the cutting tool from the interior of the envelope.

4. A device as set forth in claim 3, wherein a closing means is provided on the fourth side to close the envelope.

5. A device as set forth in claim 3, wherein said closing means is a zip lock unit.

6. A device as set forth in claim 5, wherein said cutting means includes a plurality of spaced cutting teeth.

7. A device as set forth in claim 6, wherein said teeth have a conical configuration defined by a curved surface and a straight surface generally parallel with the length of the tooth.

8. A device as set forth in claim 6, wherein said cutting teeth are spaced apart and are interconnected by cutting edges adjacent thereto.

9. A device as set forth in claim 8, wherein each tooth has a pair of convergent side edges, each tooth being at the convergent portion of the side edges.

10. A device as set forth in claim 6, wherein each tooth has a pair of convergent side edges defining a transversely V-shaped tooth.

11. A device as set forth in claim 1, wherein said cutting tool has cutting means along one edge thereof.

12. A device as set forth in claim 1, wherein said envelope is substantially flat and of thickness to receive the minimum thickness of the cutting tool therewithin.

13. A device as set forth in claim 1, wherein the envelope is elongated and has a pair of lines of weakness intermediate the ends thereof, said lines of weakness extending transversely of the longitudinal axis of the envelope, said lines of weakness defining a web having free outer ends, whereby the web can be pulled laterally to open the envelope.

14. A device as set forth in claim 13, wherein said web forms part of an upper seat defining an envelope.

* * * * *